US005908728A

United States Patent [19]

Sakaki et al.

[11] Patent Number: 5,908,728

[45] **Date of Patent: *Jun. 1, 1999**

[54] RECORDING PAPER, AND IMAGE FORMING METHOD EMPLOYING THE SAME

[75] Inventors: Mamoru Sakaki, Yamato; Masato Katayama, Yokohama; Mifune Hirose, Machida, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/548,622

[22] Filed: Oct. 26, 1995

[30] Foreign Application Priority Data

Oct. 27, 1994 [JP] Japan ..... 6-263720
Oct. 16, 1995 [JP] Japan ..... 7-267030

[51] Int. Cl.[6] ..... B41J 2/01; B41M 5/00

[52] U.S. Cl. ..... 430/126; 347/56; 347/105; 428/195; 428/211; 428/342; 428/498; 428/537.5

[58] Field of Search ..... 428/195, 206, 428/211, 411.1, 537.5, 497, 498, 340–342; 430/126; 347/56, 105

[56] References Cited

U.S. PATENT DOCUMENTS

| | | | |
|---|---|---|---|
| 2,772,970 | 12/1956 | Feigley, Jr. | 92/21 |
| 3,976,824 | 8/1976 | Ariyoshi et al. | 526/23 |
| 4,542,059 | 9/1985 | Togonoh et al. | 428/206 |
| 4,636,805 | 1/1987 | Toganoh et al. | 428/211 |
| 4,664,952 | 5/1987 | Arai et al. | 428/206 |
| 4,686,118 | 8/1987 | Arai et al. | 428/195 |
| 4,723,129 | 2/1988 | Endo et al. | 347/56 |
| 4,740,796 | 4/1988 | Endo et al. | 347/56 |
| 4,758,461 | 7/1988 | Akiya et al. | 428/195 |
| 4,785,313 | 11/1988 | Higuma et al. | 347/105 |
| 4,832,984 | 5/1989 | Kasegawa et al. | 347/105 |
| 4,849,774 | 7/1989 | Endo et al. | 347/56 |
| 4,877,680 | 10/1989 | Sakaki et al. | 428/195 |
| 4,956,223 | 9/1990 | Arai et al. | 428/195 |
| 5,041,328 | 8/1991 | Akiya et al. | 428/195 |
| 5,081,470 | 1/1992 | Kurabayashi et al. | 428/105 |
| 5,089,327 | 2/1992 | Cessna | 428/288 |
| 5,101,218 | 3/1992 | Sakaki et al. | 428/195 |
| 5,122,814 | 6/1992 | Endo et al. | 347/56 |
| 5,137,778 | 8/1992 | Nakatsugawa et al. | 428/195 |
| 5,159,349 | 10/1992 | Endo et al. | 347/56 |
| 5,182,175 | 1/1993 | Sakaki et al. | 428/537.5 |
| 5,277,962 | 1/1994 | Nakatsugawa et al. | 428/206 |
| 5,320,897 | 6/1994 | Kondo et al. | 428/195 |
| 5,338,597 | 8/1994 | Kurabayashi et al. | 428/195 |
| 5,362,558 | 11/1994 | Sakaki et al. | 420/195 |

FOREIGN PATENT DOCUMENTS

| | | |
|---|---|---|
| 4307241A1 | 9/1994 | Germany . |
| 54-59936 | 5/1979 | Japan . |
| 59-35977 | 2/1984 | Japan . |
| 61-58788 | 3/1986 | Japan . |
| 2184557 | 6/1987 | United Kingdom . |

OTHER PUBLICATIONS

"Effects of retention aids on retention and dewatering of wheat–straw pulp", Tappi Journal, Apr. 1990, vol. 73, No. 4, pp. 177–182.

*Primary Examiner*—Pamela R. Schwartz
*Attorney, Agent, or Firm*—Fitzpatrick, Cella, Harper & Scinto

[57] ABSTRACT

A recording paper formed mainly from a fibrous material with a cationic substance applied onto the surface thereof or impregnated therein contains a non-wood fiber at least. An image forming method comprises forming an image on the recording paper by the steps of developing an electrostatic image on a photosensitive member by a developing means with a toner, transferring the developed toner image from the photosensitive member onto the recording paper, and fixing the transferred toner image on the recording paper. An image forming method comprises forming an image on the recording paper by ink-jet recording by applying, onto the recording paper, droplets of an ink containing at least an acid dye and/or a direct dye, water, and a water-soluble solvent.

16 Claims, 3 Drawing Sheets

RECORDING PAPER, AND IMAGE FORMING METHOD EMPLOYING THE SAME

BACKGROUND OF THE INVENTION

1. Field of the Invention

The present invention relates to a recording paper exhibiting excellent performance as a toner-receiving paper in electrophotographic recording, and an electrophotographic image-forming method employing the recording paper.

The present invention also relates to a recording paper capable of forming sharp images in ink-jet recording, and an ink-jet image-forming method employing the recording paper.

2. Related Background Art

Electrophotographic copying machine, as an example, electrify a photoconductive sensitive member temporarily with an electrifier, form an electrostatic latent image, developing the latent image with a toner of a one-component type or a two-component type; transfer the toner on the sensitive member by a transfer-electrifier onto a recording paper delivered thereto, and fix the toner onto the recording paper by heat and/or pressure by means of a fixing roller, or the like, to obtain a final copied image.

The toner-receiving papers for use in such a copying machine are required to have properties as follows: (1) suitable electric resistivity and smoothness of the surface for satisfactory toner transfer, (2) high toner fixability, (3) less formation of paper dust, causing fewer image defects by adhesion of the formed paper dust onto a photosensitive member or an electrifying roller, (4) causing less abrasion of the photosensitive member, paper-delivering roller, or fixing roller by formed paper dust (e.g., a filler), (5) less occurrence of curling by heat, (6) less change of dimension due to humidity change, (7) high deliverability with low rigidity and an appropriate surface friction coefficient, and so forth.

Ink-jet recording is attracting attention because of its suitableness for high speed printing, color image recording, and high density recording, and the apparatuses for ink-jet recording are widely used. For ink-jet recording, specially designed papers are used, which are exemplified by a coated ink-jet paper disclosed in Japanese Patent Laid-Open Application No. 59-35977. On the other hand, in single color recording and business color recording, an ink-jet recording method is demanded which is suitable for recording onto inexpensive plain paper for general office use.

However, for electrophotographic recording, toner-receiving papers widely used in offices are not suitable for ink-jet recording, because of the disadvantages of: (1) insufficient ink fixing property, (2) insufficient water-fastness of the recorded images formed thereon with an aqueous ink, (3) insufficient color developing property for the coloring matter of the ink, and insufficient image density of the formed image, (4) occurrence of the feathering and bleeding of ink, resulting in low quality of the recorded images, and so forth.

For improving the water-fastness of the recorded images, Japanese Patent Laid-Open Application No. 61-58788 discloses recording paper which contains a polyallylamine salt. However, the recording paper containing a polyallylamine salt without a special coating layer has disadvantages that the formed image has a low density, and tends to cause bleeding.

For improving the ink fixing property, both the recording medium and the ink are investigated. The ink-recording medium is investigated for lowering the sizing degree of the recording medium itself to improve ink penetration, and wetting property. The ink is investigated for lowering the surface tension to improve wetting property and penetrability into the recording medium.

Any of the above improvements causes other problems, namely, cockling of the recording paper due to a large amount of penetration of the ink, and curling of the recording paper after ink drying.

SUMMARY OF THE INVENTION

An object of the present invention is to provide a recording paper suitable for toner-receiving paper for electrophotographic recording, and satisfying the above requirements, in particular, having excellent toner fixing property, and to provide an electrophotographic image forming method employing the recording medium.

Another object of the present invention is to provide a recording paper suitable also for ink-jet recording giving a high-quality image and a high image density at a rapid fixation rate without feathering or bleeding, and imparting good water-fastness of the recorded image, and to provide an ink-jet image forming method employing the recording medium.

A further object of the present invention is to provide a recording paper not subject to the inherent problems in ink-jet recording of cockling and curling after recording, which become significant with improvements in ink fixation, and to provide an ink-jet image forming method employing the recording medium.

The recording paper of the present invention is formed mainly from a fibrous material with a cationic substance applied onto the surface thereof or impregnated therein, containing a non-wood fiber at least.

The image forming method of the present invention forms an image on the above recording paper through the steps of developing an electrostatic image on a photosensitive member by a developing means with a toner, transferring the developed toner image from the photosensitive member onto the recording paper, and fixing the transferred toner image on the recording paper.

The image forming method in another embodiment of the present invention forms an image on the above recording paper by ink-jet recording by applying, onto the above recording paper, droplets of an ink containing at least an acid dye and/or a direct dye, water, and a water-soluble solvent.

BRIEF DESCRIPTION OF THE INVENTION

DESCRIPTION OF THE PREFERRED EMBODIMENTS

Figure 1:
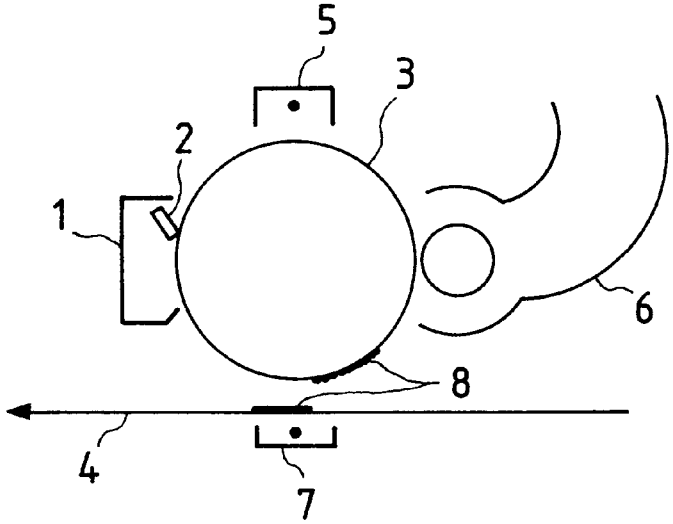
FIG. 1 illustrates schematically a recording means of an electrophotographic copying machine.

After comprehensive investigation, it was found that a paper formed mainly from a fibrous material with a cationic substance applied onto the surface thereof or impregnated therein in which the fibrous material comprises a non-wood fiber material, preferably kenaf fiber, is highly suitable for electrophotographic recording, and is also highly suitable for ink-jet recording with excellent properties in ink fixation, water-fastness of recorded image, color development of coloring matter, density of the formed images, quality of the formed images, and so forth without the disadvantages of cockling and curling after recording. The present invention has been completed on the basis of the above findings.

The recording paper of the present invention is characterized by the base material being composed mainly of a fibrous material obtained from non-wood fiber (i.e., non-wood pulp). The non-wood fiber herein means a vegetable fiber excluding wood fiber, for example, fibers of paper mulberry, mitsumata, flax, straw, sea weed, kenaf, bamboo, pineapple, bagasse, and the like. Such a starting material is mechanically disintegrated, or chemically digested, and bleached if necessary, to obtain non-wood pulp in a similar manner as in the production of wood pulp.

The recording paper of the present invention is produced by sheet formation of the above non-wood material, by use of a size, a filler, and other auxiliary agents if necessary, in a conventional sheet-forming method. The pulp employed in the present invention may additionally contain wood pulp such as chemical pulp exemplified by LBKP and NBKP, and mechanical pulp.

The non-wood fiber exhibits remarkable effects in resolving the problems which accompany the aforementioned improvements of ink fixing property and image water-fastness, problems such as cockling, bleeding, and curling after recording.

The non-wood fiber is contained preferably from 30% to 95% by weight, more preferably from 50% to 95% by weight in the entire fibrous material. At a content higher than 95% by weight, feathering tends to be significant.

Of the non-wood fiber, kenaf fiber is particularly effective against cockling and curling.

Combined use of waste paper-regenerated pulp is effective in prevention of the possible feathering which may be caused by use of non-wood fiber. The waste paper-regenerated pulp is preferably contained at a content of from 0 to 50% by weight, more preferably from 10% to 40% by weight in the paper for this purpose.

The filler which may be used in the present invention includes calcium carbonate, kaolin, talc, magnesium carbonate, and the like. The size which may be used in combination with such a filler includes neutral rosin size, alkyl ketene dimers, alkali size such as alkenylsuccinic anhydride, and acid rosin. For fixing the above size, aluminum sulfate may be used as the fixing agent in a small amount.

The recording paper is required essentially to have a cationic substance applied thereon or impregnated therein.

The cationic substance may be either a low-molecular cationic substance or a high-molecular cationic substance. The present invention employs at least one kind of cationic substance. The low-molecular cationic substance and the high-molecular cationic substance may be used in combination for effective improvement of water-fastness of images, color development of ink, and quality of images. The low-molecular cationic substance has preferably a weight-average molecular weight of not higher than 1000, more preferably from 100 to 700, and the high-molecular cationic substance has preferably a weight-average molecular weight of not lower than 2000, more preferably from 2000 to 10,000.

The low-molecular cationic substance having a molecular weight of not higher than 1000 specifically includes hydrochlorides and acetates of primary, secondary, and tertiary amines such as laurylamine, coconut-amine, stearylamine, and rosin-amine; quaternary ammonium compounds such as lauryltrimethylammonium chloride, lauryldimethylbenzylammonium chloride, benzyltributylammonium chloride, and benzalkonium chloride; pyridinium type compounds such as cetylpyridinium chloride, and cetylpyridinium bromide; imidazoline type cationic compounds such as 2-heptadecenyl-hydroxyethylimidazoline; and ethylene oxide adducts of higher alkylamines such as dihydroxyethylstearylamine. A metallic compound may be used therefor, such as aluminum lactate, basic polyaluminum hydroxide, aluminum chloride, sodium aluminate, and aluminum acrylate.

The high-molecular cationic substance having a molecular weight of not lower than 2000 specifically includes polyallylamine and salts thereof, e.g., hydrochloride; polyaminesulfone and salts thereof, e.g., hydrochloride; polyvinylamine and salts thereof, e.g., hydrochloride; chitosan and salts thereof, e.g., acetate, but is not limited thereto. The type of salt thereof is not limited to hydrochloride and acetate. The high-molecular cationic substance may be prepared by partially cationizing a nonionic high-molecular substance. Specific examples thereof include a copolymer of vinylpyrrolidone and a quaternary salt of an aminomethylalkyl acrylate, a copolymer of acrylamide and a quaternary salt of aminomethylacrylamide, and the like, but are not limited thereto. The aforementioned high-molecular substance or the cationic high-molecular substance is preferably water-soluble, but may be dispersible in a state of a latex or an emulsion.

When the low-molecular cationic substance and the high-molecular cationic substance are used in combination, the ratio thereof is in the range of from 20/1 to 1/20. Within this range, the recorded image has higher water-fastness, and is excellent in image quality and image density.

The cationic substance is applied to the recording paper sheet preferably in an amount of from 0.05 to 7 g/m$^2$. At an amount of lower than 0.05 g/m$^2$, the effect of the cationic substance is not achieved, whereas at an amount of higher than 7 g/m$^2$, the ink absorbency is lower and bleeding is liable to occur. More preferably the applied amount is in the range of from 0.1 to 3 g/m$^2$.

The recording paper of the present invention is prepared by applying or impregnating a coating liquid on or into a base paper made from the aforementioned materials.

The coating liquid may contain, as auxiliary material if desired, casein, starch; a cellulose derivative such as carboxymethylcellulose, and hydroxymethylcellulose; a hydrophilic resin capable of being swelled by ink such as polyvinyl alcohol, polyvinylpyrrolidone, sodium polyacrylate, and polyacrylamide; a resin having hydrophilic portions and hydrophobic portions in the molecule such as SBR latexes, acrylic emulsions, and styrene-acrylate copolymers; a water-repellent substance such as silicone oil, paraffin, wax, and fluorine compounds; a resin such as the aforementioned sizing agents; an inorganic pigment such as silica, aluminum silicate, magnesium silicate, hydrotalcite, calcium carbonate, titanium oxide, clay, talc, and magnesium (basic) carbonate; an organic pigment such as urea resins, urea-formalin resins, polyethylene resins, and polystyrene resins.

Such an auxiliary material is applied in an amount of from about 0.1 to about 7 g/m$^2$ on the recording surface. When the coating liquid contains a pigment, the coating liquid is applied in such an amount that the pigment and the fibrous material distribute in combination on the recording surface, preferably the pigment covers not more than half of the recording surface. If the recording surface is excessively covered by the pigment, recording paper has a feel different from that of ordinary paper, and is likely to cause failure in paper delivery in an electrophotographic recording apparatus.

In the preparation of the recording paper of the present invention, the aqueous liquid containing a cationic substance, a resin, and other additives as mentioned above is applied on the surface of a base material by a conventional method such as a roll coater method, a blade coater method, an air knife coater method, a gate roll coater method, a size press method, and a shim size method, and subsequently the coated matter is dried by an air drier, a heating drum, or the like. Further, the resulting paper may be supercalender finished for smoothing or strengthening of the surface.

The Stöckigt sizing degree of the recording paper of the present invention preferably ranges from 0 to 15 seconds. When recording is conducted on a recording paper of a St öckigt sizing degree of higher than 15 seconds with an ink having a high surface tension, the quality of the formed image is likely to be impaired due to low ink fixing ability and occurrence of bleeding, particularly in color recording. However, the recording paper can be used without the above disadvantage for ink-jet recording with an ink which has a low surface tension to facilitate penetration of the ink into the paper sheet.

Figure 2:
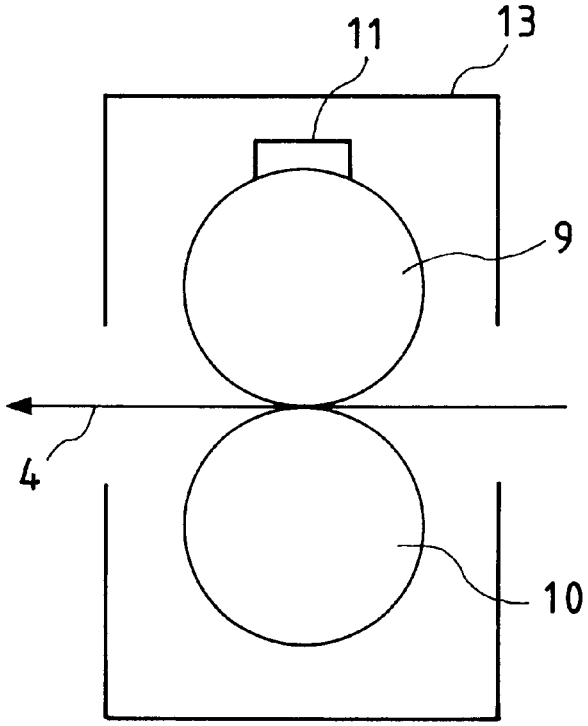
FIG. 2 illustrates schematically a fixing device of an electrophotographic copying machine.

FIG. 1 illustrates schematically a recording means of an electrophotographic copying machine. A photoconductive sensitive member 3 is electrified temporarily by an electrifier 5. The sensitive drum is exposed to light imagewise to form an electrostatic latent image. The latent image is developed with a toner 8 of a one- or two-component type developer to form a toner image. The toner image is transferred by a transfer electrifier 7 as the transfer means from the surface of the sensitive member to a recording paper sheet 4 fed from outside. Then the toner image is fixed on the recording paper sheet 4 by a fixing device 13 having a pair of rollers 9, 10 (otherwise, one roller and a belt) as a fixing means as shown in FIG. 2 by application of heat and/or pressure to obtain the final copied image. Unfixed toner and paper dust formed from the printing paper sheet 4 in the transfer process are removed to clean the photosensitive member 3 by a cleaner device 1 placed after the transfer step. After the cleaning with a cleaning member 2 (e.g., a cleaning blade) in contact with the photosensitive member 3, the surface of the photosensitive member is repeatedly subjected to the steps of electrification, etc. In the fixing device 13, as shown in FIG. 2, the unfixed toner and the paper dust from the recording paper sheet 4 on the fixation roll 9 are removed with the cleaning member 11 brought into contact therewith and simultaneously a releasing agent such as silicone oil is applied to the roller.

The ink-jet recording system is explained below.

The image forming method of the present invention is applicable to any known ink-jet recording system which ejects droplets of an ink through a nozzle to apply ink onto the recording medium. A typical example of the effective ink-jet recording system is disclosed in Japanese Patent Laid-Open Application No. 54-59936, in which thermal energy is given to the ink to cause an abrupt change of the volume of the ink and to eject ink from a nozzle by the phase change energy.

Figure 3:
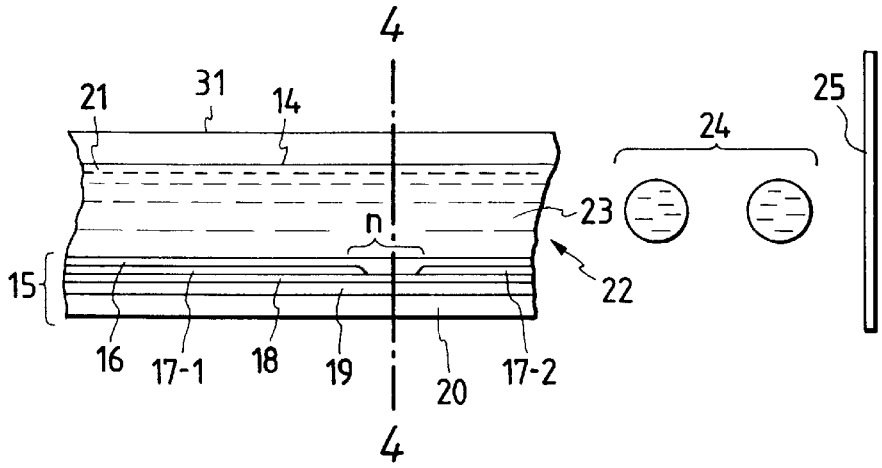
FIG. 3 is a vertical sectional view of a head portion of an ink-jet recording apparatus employed in the present invention.
Figure 4:
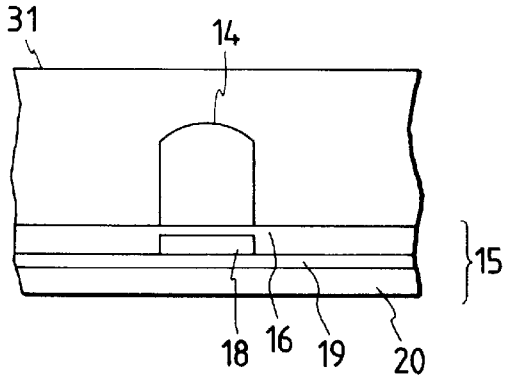
FIG. 4 is a lateral sectional view of a head portion of an ink-jet recording apparatus employed in the present invention.
Figure 5:
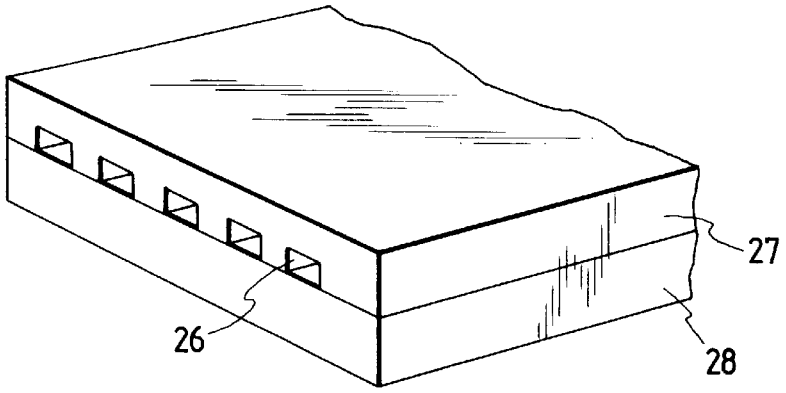
FIG. 5 is a perspective external view of a head portion constructed by multiplication of the heads shown in FIGS. 3 and 4.

An example of the ink-jet recording apparatus which is suitable for ink-jet recording of the present invention is explained by reference to the drawings. FIGS. 3, 4, and 5 illustrate an example of the construction of a head which is the essential part of the apparatus.

In these drawings, a head 31 is constructed by bonding a plate of glass, ceramics, plastics, or the like having grooves 14 for ink flow with a heat-generating head 15 for thermal recording. (The heat-generating head is not limited to the one shown in the drawings.) The heat-generating head 15 is constituted of a protection layer 16 formed from silicon oxide or the like; aluminum electrodes 17-1, 17-2; a heat-generating resistance layer 18 made of nichrome or the like; a heat-accumulating layer 19; and a heat-radiating substrate plate 20 made of alumina or the like.

The ink 21 fills an ejection orifice (fine nozzle) 22, and has a meniscus 23 formed by pressure.

On application of electric signal information to the electrodes 17-1, 17-2 of the head, the region denoted by "n" on the heat-generating head 15 generates heat abruptly to form bubbles in the ink 21 near that region, the pressure of the bubble pushes out the meniscus 23 to eject the ink 21 from the orifice 22 in the shape of droplets 24. The ejected ink droplets travel toward a recording medium 25.

FIG. 5 shows an external appearance of a multiple head integrating a plurality of heads shown in FIG. 3. The multiple head is formed by bonding a glass plate 27 having multiple grooves 26 with the heat-generating head 28 like the one shown in FIG. 3. FIG. 3 is a sectional view of the head 31 along the ink flow path, and FIG. 4 is a sectional view taken at the line 4—4 in FIG. 3.

Figure 6:
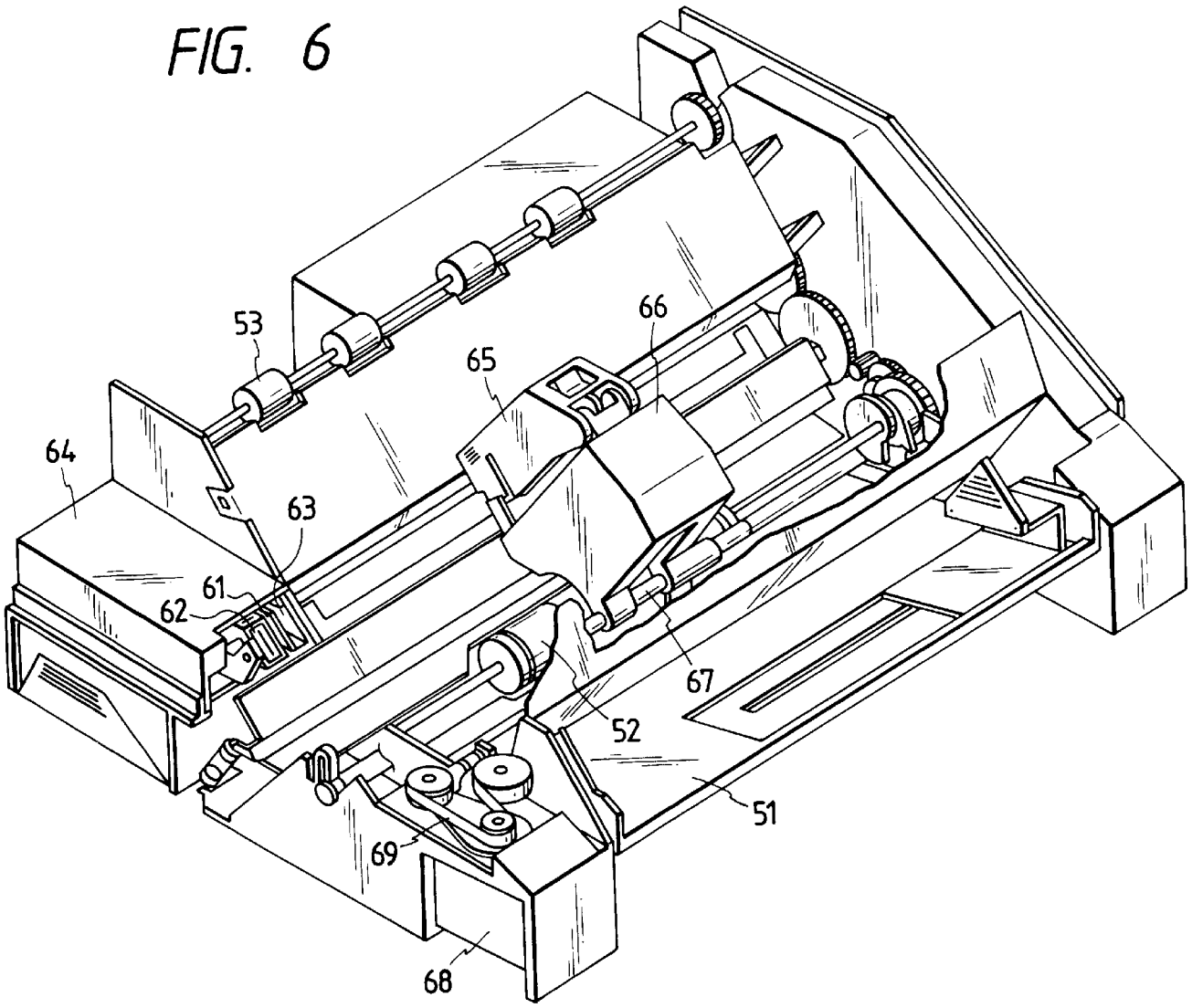
FIG. 6 is a perspective external view of an ink-jet recording apparatus.

FIG. 6 shows an example of the entire ink-jet recording apparatus equipped with the above-described head. In FIG. 6, a blade 61 as a wiping member is held at one end of the blade by a blade-holding member, forming a fixed end in the shape of a cantilever. The blade 61 is placed at a position adjacent to the recording region of the recording head, and, in this example, is held so as to protrude into the moving path of the recording head. The cap 62 is placed at a home position adjacent to the blade 61, and is constituted such that it moves in the direction perpendicular to the moving direction of the recording head to come into contact with the ejection nozzle face to cap the nozzle. An ink absorbent 63 is placed at a position adjacent to the blade 61, and is held so as to protrude into the moving path of the recording head in a manner similar to that of the blade 61. The blade 61, the cap 62, and the absorbent 63 constitute an ejection recovery device 64. The blade 61, and the absorbent 63 serve to remove water, dust, and the like from the face of the ink ejection nozzle.

A recording head 65 has an energy-generating means for the ejection, and conducts recording by ejecting the ink onto a recording medium opposite the ejection nozzle face. A carriage 66 is provided for supporting and moving the recording head 65. The carriage 66 is engaged slidably with a guide rod 67. A portion of the carriage 66 is connected (not shown in the drawing) to a belt 69 driven by a motor 68, so that the carriage 66 is movable along the guide rod 67 to the recording region of the recording head 65 and the adjacent region thereto.

A paper sheet delivery device 51 for delivery of a recording medium and a paper sheet delivery roller 52 driven by a motor (not shown in the drawing) delivers a recording medium to the position opposite the ejection nozzle face of the recording head, and the recording medium is delivered with the progress of the recording to a paper discharge device provided with paper sheet-discharging rollers 53.

In the above apparatus, when the recording head 65 returns to the home position on completion of recording, the cap 62 of the ejection-recovery device 64 is positioned out of the moving path of the recording head 65, and the blade 61 is allowed to protrude into the moving path. Thereby, the ejecting nozzle face of the recording head 65 is wiped. To cap the ejection face of the recording head 65, the cap 62 protrudes toward the moving path of the recording head to come into contact with the ejection nozzle face.

When the recording head 65 is made to move from the home position to the record-starting position, the cap 62 and the blade 61 are at the same position as in the above-mentioned wiping step, so that the ejection nozzle face of the recording head 65 is wiped also in this movement.

The recording head is moved to the home position not only at the completion of the recording and at the time of ejection recovery, but is also moved at predetermined intervals during recording from the recording region. The nozzle is wiped by such movement.

For color printing by ink-jet recording, four recording heads holding respectively inks of black, cyan, magenta, and yellow are juxtaposed horizontally or vertically on the carriage 66. The inks may be three colors of cyan, magenta, and yellow in place of the four colors.

The ink used in the present invention is described below.

The ink comprises a water-soluble dye having an anionic group, water, a water-soluble organic solvent, and other additives such as a viscosity-adjusting agent, a pH-controlling agent, an antiseptic agent, a surfactant, and an antioxidant.

The water-soluble dye having an anionic group used in the present invention may be selected from the water-soluble dyes of acid dyes, direct dyes, and reactive dyes listed in the Color Index without any limitation. Further, any dye having an anionic group such as a sulfonic group and a carboxylic group may be used without limitation even though it is not listed in the Color Index. The water-soluble dye herein includes naturally those having a pH-dependent solubility. Of these dyes, direct dyes and acid dyes are particularly preferred in consideration of color tone.

The water-soluble organic solvent for the ink includes amides such as dimethyl formamide and dimethylacetamide; ketones such as acetone; ethers such as tetrahydrofuran and dioxane; polyalkylene glycols such as polyethylene glycol and polypropylene glycol; alkylene glycols such as ethylene glycol, propylene glycol, butylene glycol, triethylene glycol, 1,2,6-hexanetriol, thiodiglycol, hexylene glycol, and diethylene glycol; lower alkyl ethers of polyhydric alcohols such as ethylene glycol monomethyl ether, diethylene glycol monomethyl ether, and triethylene glycol monomethyl ether, monohydric alcohols such as ethanol, isopropyl alcohol, n-butyl alcohol, and isobutyl alcohol; and glycerin, N-methyl-2-pyrrolidone, 1,3-dimethyl-imidazolidinone, triethanolamine, sulfolane, dimethylsulfoxide, and the like.

The content of the above water-soluble organic solvent in the ink is preferably in the range of from 1% to 50% by weight, more preferably from 2% to 30% by weight, but is not limited thereto.

The ink may contain, if necessary, other additives such as a viscosity-adjusting agent, a pH-controlling agent, an antiseptic agent, a surfactant, an antioxidant, an evaporation accelerator, and the like. The selection of the surfactant is particularly important for controlling the penetration of the liquid.

The ink has preferably the following properties at around 25° C.: a pH of from 3 to 12, a surface tension of from 10 to 60 dyn/cm, and a viscosity of from 1 to 30 cp. More preferably, the surface tension of the respective color inks of yellow, magenta, and cyan is in the range of from 25 to 40 dyn/cm in view of the ink-fixing properties, and the image quality. However, when the recording paper has a Stöckigt sizing degree adjusted for improvement of ink penetration, the properties of the ink may be outside the above ranges.

When the ink has a surface tension higher than 40 dyn/cm, expected effects cannot be achieved in the ink fixing properties and image uniformity on the recording paper of the present invention, while, when the ink has a surface tension lower than 25 dyn/cm, feathering of the image is likely to occur and the image quality tends to be lower.

The present invention is described below in more detail by reference to Examples. The term "parts" in the Examples is based on weight unless otherwise mentioned.

EXAMPLE 1

(Preparation of Base Paper Sheets 1 to 6)

The starting pulps employed are shown in Table 1. To 100 parts of the starting pulp, were mixed 10 parts of kaolin (produced by Tsuchiya Kaolin K.K.), 0.4 part of cationized starch, 1 part of aluminum sulfate, and 0.25 part of neutral rosin sizing agent (Size Pine NT, produced by Arakawa Kagaku K.K.). From the mixtures, Base Paper Sheets 1 to 6 were respectively prepared in a basis weight of 80 g/m$^2$ in a conventional manner. In Table 1, Non-Wood Pulp (1) was the one produced from kenaf, and Non-Wood Pulp (2) was the one produced from bagasse. The numbers for the pulp formulation are based on weight.

The respective base paper sheets were impregnated or coated with the application liquid prepared by mixing and dissolving the components below, and dried at 120° C. for one minute in an oven to prepare the recording paper sheets of the present invention and for comparison. The combinations of the base paper sheet, the applied liquid, and the amount of application are shown in Table 1.

| | |
|---|---|
| (Liquid Composition A) | |
| Water only | |
| (Liquid Composition B) | |
| Polyallylamine hydrochloride (PAA-HC1-3L, molecular weight: 10,000 Nitto Boseki Co., Ltd.) | 0.8 part |
| Water | 99.2 parts |
| (Liquid Composition C) | |
| Benzalkonium chloride (G-50, Sanyo Chemical Industries Ltd.) | 0.2 part |
| Polyallylamine hydrochloride (PAA-HC1-3L, molecular weight: 10,000 Nitto Boseki Co., Ltd.) | 0.8 part |
| Water | 99.0 parts |
| (Liquid Composition D) | |
| Aluminum acrylate (P-3, Asada Kagaku K.K.) | 0.2 part |
| Polyallylamine hydrochloride (PAA-HC1-3L, molecular weight: 10,000 Nitto Boseki Co., Ltd.) | 0.8 part |
| Water | 99.0 parts |
| (Liquid Composition E) | |
| Fine powdery silica (Mizuka Sil P-78D, Mizusawa Kagaku K.K.) | 10 parts |
| Polyvinyl alcohol (PVA 117, Kuraray Co., Ltd) | 4 parts |

-continued

| | |
|---|---|
| Polyallylamine hydrochloride (PAA-HC1-3L, molecular weight: 10,000 Nitto Boseki Co., Ltd.) | 0.6 part |
| Benzalkonium chloride (G-50, Sanyo Chemical Industries Ltd.) | 0.4 part |
| Water | 85.0 parts |

Application Liquid E was applied on the base paper sheet by a bar coater method, and dried under the same conditions as the other application liquids.

The inks of yellow, magenta, cyan, and black: (1) -Y, (1) -M, (1) -C, and (1) -K were prepared by mixing the components below and filtering them through a membrane filter of a pore size of 0.22 μm (Fluoropore Filter, trade name, Sumitomo Electric Industries, Ltd.) under pressure.

(1) -Y

| | |
|---|---|
| C.I. Direct Yellow 86 | 2.5 parts |
| Thiodiglycol | 7.5 parts |
| Glycerin | 7.5 parts |
| Urea | 7.5 parts |
| Acetylenol EH | 1 part |
| Water | balance |

(1) -M

The same as (1) -Y above except that the dye was replaced by 3.0 parts of C.I. Acid Red 35.

(1) -C

The same as (1) -Y above except that the dye was replaced by 3.0 parts of C.I. Direct Blue 199.

(1) -K

The same as (1) -Y above except that the dye was replaced by 3.5 parts of C.I. Food Black 2.

The respective four inks had a surface tension of 29 dyn/cm and viscosity of 2 cp.

(Evaluation of Suitability for Ink-Jet Recording)

On the resulting recording paper sheet, a color image was formed with the above-described inks by means of a recording apparatus which was equipped with a bubble jet type recording head having about 14 recording nozzles per mm and ejecting ink droplets by action of thermal energy. The recorded image was evaluated as below.

1. Image Density:

On the recording paper, a solid image was printed with the black ink at 100% duty. After standing for 12 hours, the printed solid image was subjected to measurement of reflection density by means of a reflection densitometer, Macbeth RD-918 (MacBeth Co.).

2. Bleeding:

Solid images were printed with single colors (yellow, magenta, and cyan) at 100% duty and with mixed colors (red, green, and blue) at 200% duty adjacent to each other on the recording paper sheet, and the sharpness at the borders between the respective colors was evaluated visually. Those which caused little color mixing and no bleeding practically at the borders between the solid color images at 200% duty were marked as A. Those which caused color mixing at the borders between the solid color images at 200% duty, but no bleeding at 100% duty were marked as B. Those which caused color mixing at the borders between the solid color images at 100% duty were marked as C. Those on which the border lines between the 200% duty portions were observed to be nearly straight were marked as AA.

3. Quality of Recorded Characters:

Intricate Chinese characters were printed at 100% duty. The recording paper sheet which gave sharp letters was marked as A. Those on which the printed letters were not decipherable were marked as C. Those on which the printed letters were of low quality but were decipherable were marked as B.

4. Water-Fastness of Printed Characters:

Onto the characters printed at 100% duty, a drop of water was allowed to fall from a dropping pipet, and was dried spontaneously. The printed characters were evaluated visually. When the characters did not ran but became fat, the printing was marked as A. When the characters did not run and did not become fat, the printing was marked as AA. When the characters ran but were decipherable, the printing was marked as B. When the characters were not decipherable, the printing was marked as C.

5. Cockling:

Blue solid images were printed at 200% duty on the recording paper sheet. The printed matter was observed visually. The paper sheet was marked as C when it cockled noticeably immediately after the printing and the cockling did not disappear after 12 hours. A sheet was marked as A when it cockled to some extent immediately after the printing but the cockling disappeared after 12 hours. A sheet was marked as AA when it cockled little immediately after the printing.

6. Curling after Recording:

The same pattern as in evaluation of cockling was printed on the recording paper sheet. The recording paper sheet was marked as C when the curling was noticeable with its ends curled inside 12 hours after the printing. A sheet was marked as A when the curling was not noticeable after 12 hours.

(Evaluation of Suitability for Electrophotographic Recording)

Electrophotographic recording was conducted on the recording paper sheet with a copying machine NP-9800 (trade name, Canon K.K.) and a color copying machine CLC-500 (trade name, Canon K.K.), both having an image-forming device illustrated in FIG. 1 and a fixing device illustrated in FIG. 2. The quality of the copied image was rated on three grades of A: good (good in color feeling, color reproducibility, and colorfulness), B: fair, and C: poor (dullness in color, and blank of recording).

The results are summarized in Table 1.

As shown in the Examples and Comparative Examples, the recording paper sheet of the present invention is suitable for ink-jet recording to form images of high quality having excellent water-fastness at a high recording density without bleeding or feathering. Obviously in comparison with the Comparative Examples, the recording paper sheet of the present invention, which contains non-wood fiber material, solved effectively the problems of cockling, and curling after the recording inherent to ink-jet recording.

As described above, the recording paper sheet of the present invention has the feeling of common paper, and is suitable both for an ink-jet recording system and for an electrophotographic recording system. Therefore, the recording paper sheet of the present invention is useful in a wide range of application fields, and can be supplied at a low cost in comparison with conventional specially designed ink-jet recording paper. The recording paper of the present invention is much more suitable for ink-jet recording than conventional recording papers.

TABLE 1

| Recording paper sheet No. | Applied liquid No. | Amount of application (g/m²) | Base paper sheet No. | Formulation of pulp of base paper (wt. parts) LBKP | Non-wood (1) | Non-wood (2) | Waste paper · DIP | Remark * |
|---|---|---|---|---|---|---|---|---|
| 1 | A | — | 1 | 100 | — | — | — | Cmp. Ex. 1 |
| 2 | B | 2 | 1 | 100 | — | — | — | Cmp. Ex. 2 |
| 3 | B | 2 | 2 | 50 | 50 | — | — | Ex. 1 |
| 4 | B | 2 | 3 | 25 | 75 | — | — | Ex. 2 |
| 5 | B | 2 | 4 | — | 100 | — | — | Ex. 3 |
| 6 | B | 2 | 5 | 50 | — | 50 | — | Ex. 4 |
| 7 | B | 2 | 6 | — | 75 | — | 25 | Ex. 5 |
| 8 | C | 2 | 1 | 100 | — | — | — | Cmp. Ex. 3 |
| 9 | C | 2 | 2 | 50 | 50 | — | — | Ex. 6 |
| 10 | C | 2 | 3 | 25 | 75 | — | — | Ex. 7 |
| 11 | C | 2 | 4 | — | 100 | — | — | Ex. 8 |
| 12 | C | 2 | 5 | 50 | — | 50 | — | Ex. 9 |
| 13 | C | 2 | 6 | — | 75 | — | 25 | Ex. 10 |
| 14 | D | 0.5 | 1 | 100 | — | — | — | Cmp. Ex. 4 |
| 15 | D | 0.5 | 3 | 25 | 75 | — | — | Ex. 11 |
| 16 | E | 4 | 1 | 100 | — | — | — | Cmp. Ex. 5 |
| 17 | E | 4 | 3 | 25 | 75 | — | — | Ex. 12 |

| Recording paper sheet No. | Suitability: Ink-jet recording: Image density | Bleeding | Character quality | Water fastness | Cockling | Curling after recording | Electrophotographic recording | Remark * |
|---|---|---|---|---|---|---|---|---|
| 1 | 1.00 | B | C | C | C | C | C | Cmp. Ex. 1 |
| 2 | 1.21 | C | A | A | C | C | A | Cmp. Ex. 2 |
| 3 | 1.22 | B | A | A | A | A | A | Ex. 1 |
| 4 | 1.23 | A | B | A | A | A | A | Ex. 2 |
| 5 | 1.22 | A | B | A | AA | A | A | Ex. 3 |
| 6 | 1.22 | A | B | A | A | A | A | Ex. 4 |
| 7 | 1.24 | A | A | A | A | A | A | Ex. 5 |
| 8 | 1.28 | A | A | AA | C | C | A | Cmp. Ex. 3 |
| 9 | 1.30 | AA | A | AA | A | A | A | Ex. 6 |
| 10 | 1.31 | AA | A | AA | A | A | A | Ex. 7 |
| 11 | 1.31 | AA | A | AA | AA | A | A | Ex. 8 |
| 12 | 1.30 | AA | A | AA | A | A | A | Ex. 9 |
| 13 | 1.32 | AA | A | AA | A | A | A | Ex. 10 |
| 14 | 1.17 | A | A | AA | C | C | A | Cmp. Ex. 4 |
| 15 | 1.16 | AA | B | AA | A | A | A | Ex. 11 |
| 16 | 1.53 | A | A | AA | C | C | A | Cmp. Ex. 5 |
| 17 | 1.52 | AA | A | AA | A | A | A | Ex. 12 |

* Ex.: Example
Cmp. Ex.: Comparative Example

What is claimed is:

1. A recording paper comprising a fibrous base material which comprises a non-wood vegetable fiber, and a cationic substance and at least one of an inorganic pigment and an organic pigment applied onto the surface of said fibrous base material, wherein the fibrous base material contains the non-wood vegetable fiber at a content of from 50% to 95% by weight.

2. The recording paper according to claim 1, wherein the non-wood vegetable fiber is a kenaf fiber.

3. The recording paper according to claim 1, wherein the fibrous base material contains a waste paper-regenerated pulp at a content of from 0% to 50% by weight.

4. The recording paper according to claim 1, comprising at least a first cationic substance having a weight-average molecular weight of not higher than 1000 and a second cationic substance having a weight-average molecular weight of not lower than 2000.

5. The recording paper according to claim 4, wherein the first cationic substance has a weight average molecular weight of from 100 to 700.

6. The recording paper according to claim 4, wherein the second cationic substance has a weight average molecular weight of from 2,000 to 10,000.

7. The recording paper according to claim 4, wherein a weight ratio of the first cationic substance to the second cationic substance is in a range of 20:1 to 1:20.

8. The recording paper according to claim 1, wherein an amount of the cationic substance applied is in a range of from 0.05 to 7 g/m².

9. The recording paper according to claim 8, wherein an amount of the cationic substance applied is in a range of from 0.1 to 3 g/m².

10. The recording paper according to claim 1, which has a Stöckigt sizing degree of from 0 to 15 seconds.

11. The recording paper according to claim 1, wherein said base material comprises a filler.

12. The recording paper according to claim 11, wherein said filler includes calcium carbonate, kaolin, talc or magnesium carbonate.

13. The recording paper according to claim 1, wherein said base material comprises a size selected from the group consisting of neutral rosin size, alkyl ketene dimers, alkenylsuccinic anhydride and acid rosin.

14. An image forming method, forming an image on a recording paper through steps of developing an electrostatic image on a photosensitive member by a developing means with a toner, transferring the developed toner image from the photosensitive member onto the recording paper, and fixing the transferred toner image on the recording paper, wherein the recording paper set forth in any of claims 1–13 is employed.

15. An image forming method, forming an image on a recording paper by ink-jet recording by applying, onto the recording paper, droplets of an ink containing at least an acid dye and/or a direct dye, water, and a water-soluble solvent, wherein the recording paper set forth in any of claims 1–13 is employed.

16. The image forming method according to claim 15, wherein the ink-jet recording is conducted by ejecting the ink by action of thermal energy to the ink.

* * * * *

UNITED STATES PATENT AND TRADEMARK OFFICE

CERTIFICATE OF CORRECTION

PATENT NO. : 5,908,728

DATED : June 1, 1999

INVENTOR(S) : MAMORU SAKAKI, ET AL.

It is certified that error appears in the above-indentified patent and that said Letters Patent is hereby corrected as shown below:

COLUMN 1:

Line 17, "machine, as an" should read --machines, for--.

COLUMN 5:

Line 22, delete "St".
Line 23, "öckigt" should read --Stöckigt--.

COLUMN 10:

Line 12, "ran" should read --run--.

Signed and Sealed this

Twenty-third Day of November, 1999

*Attest:*

Q. TODD DICKINSON

*Attesting Officer*

*Acting Commissioner of Patents and Trademarks*